US008702134B2

(12) United States Patent
Lesjak

(10) Patent No.: US 8,702,134 B2
(45) Date of Patent: Apr. 22, 2014

(54) DOOR LOCK DEVICE FOR AN ELECTRIC HOUSEHOLD APPLIANCE WITH MOVABLE LATCH

(75) Inventor: Zvonko Lesjak, Tolmin (SI)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/147,838

(22) PCT Filed: Feb. 2, 2010

(86) PCT No.: PCT/US2010/022898

§ 371 (c)(1),
(2), (4) Date: Aug. 4, 2011

(87) PCT Pub. No.: WO2010/091019

PCT Pub. Date: Aug. 12, 2010

(65) Prior Publication Data

US 2011/0291427 A1 Dec. 1, 2011

(30) Foreign Application Priority Data

Feb. 5, 2009 (IT) ..... TO2009A0077

(51) Int. Cl.
*E05B 15/02* (2006.01)

(52) U.S. Cl.
USPC ..... 292/340; 292/341.15; 292/341.17; 292/341.18; 292/DIG. 69

(58) Field of Classification Search
USPC ..... 292/228, DIG. 69, 341.15, 340, 341.12, 292/341.13, 341.17, 341.18, 341.19
See application file for complete search history.

(56) References Cited

U.S. PATENT DOCUMENTS 975,013 A * 11/1910 Augenbraun ..... 70/150
1,634,635 A * 7/1927 Crooks et al. ..... 292/173
2,233,078 A * 2/1941 Hagstrom ..... 292/254

(Continued)

FOREIGN PATENT DOCUMENTS

EP 0878576 A1 11/1998
FR 1528885 A 6/1968
FR 2114070 A5 6/1972

OTHER PUBLICATIONS

ISR for PCT/US2010/022898 dated Mar. 24, 2010.

(Continued)

*Primary Examiner* — Kristina Fulton
*Assistant Examiner* — Faria Ahmad
(74) *Attorney, Agent, or Firm* — Lowe Hauptman & Ham LLP

(57) ABSTRACT

A door lock device for an electric household appliance with movable latch, in particular a dryer, where the latch is carried by the door of the electric household appliance rotating on a plane, normally perpendicular to a door rotation axis, including a frame carried in use by the casing of the electric household appliance and provided with striker means for the latch; where the striker means are obtained on a pair of opposite jaws carried by the frame adjacent to each other and movable against the bias of elastic means and where the frame is provided with guiding means for the jaws adapted to cause the jaws to be driven apart from each other in response to a traction exerted in use on the latch, said elastic means and guiding means being arranged so that the movement of the jaws occurs on a plane arranged perpendicular in use to the rotation plane of the latch.

6 Claims, 2 Drawing Sheets

(56) References Cited

U.S. PATENT DOCUMENTS

| | | | | | |
|---|---|---|---|---|---|
| 2,696,999 | A | * | 12/1954 | Rop | 292/332 |
| 2,764,874 | A | * | 10/1956 | Sharpe | 62/161 |
| 2,772,106 | A | | 11/1956 | Semelka | |
| 2,790,665 | A | | 4/1957 | Vanderveld | |
| 2,793,891 | A | * | 5/1957 | Frye | 292/18 |
| 2,869,952 | A | * | 1/1959 | Saunders | 312/405 |
| 6,145,898 | A | | 11/2000 | Onderka et al. | |
| 7,159,910 | B2 | * | 1/2007 | Hwang | 292/341.15 |
| 8,047,585 | B1 | * | 11/2011 | Peabody et al. | 292/341.16 |
| 8,123,312 | B2 | * | 2/2012 | Jeon et al. | 312/228 |
| 8,246,089 | B2 | * | 8/2012 | Mueller et al. | 292/341.15 |

OTHER PUBLICATIONS

Search Report for Italian Patent Application No. TO2009A000077 dated Nov. 3, 2009.

* cited by examiner

DOOR LOCK DEVICE FOR AN ELECTRIC HOUSEHOLD APPLIANCE WITH MOVABLE LATCH

RELATED APPLICATIONS

The present application is national phase of PCT/US2010/022898 filed Feb. 2, 2010, and claims priority from Italian Application Number TO2009A000077 filed Feb. 5, 2009.

TECHNICAL FIELD

The present invention relates to a door lock device for an electric household appliance having the door provided with a movable latch, typically rotating about an axis parallel to the rotation axis of the door, such as for example a dryer.

BACKGROUND ART

It is known that in these particular applications, the door lock device should not only ensure the door closing in use, but also allow the door opening in case of emergency, due to a push of predetermined extent exerted thereon from the inside of the door itself, e.g. by a child remaining accidentally closed inside the drum of the electric household appliance.

Such a function was achieved in the prior art by means of costly and/or large-sized door lock devices, in all cases of complex construction and not always reliable in operation.

DISCLOSURE OF INVENTION

It is the object of the present invention to overcome the drawbacks of the prior art by providing a door lock device of simple, reliable construction, not very large in size and relatively cost-effective.

The present invention thus relates to a door lock device for an electric household appliance, as defined in claim 1.

In particular, the door lock device of the invention is made for an electric household appliance with movable latch, in particular a dryer, in which the latch is carried by the door of the electric household appliance rotating on a plane, normally perpendicular to a door rotation axis.

The door lock device comprises a frame carried in use by the casing of the electric household appliance and provided with striker means for the latch; according to an aspect of the invention, the striker means are obtained on a pair of opposite jaws carried by the frame adjacent to each other and movable against the bias of elastic means; the frame is further provided with guiding means for the jaws adapted to cause the jaws to be driven apart from each other in response to a traction exerted in use on the latch when this engages the striker means.

In particular, the aforesaid elastic and guiding means are arranged so that the movement of the jaws occurs on a plane arranged perpendicular in use to the rotation plane of the latch and so as to release the striker means from the latch.

According to a further aspect of the invention, the striker means consist in a respective tooth for each jaw which extends to protrude from the jaw on a plane perpendicular to the rotation plane of the latch; each tooth being adapted to engage only a part of a corresponding fastening tooth of the latch.

Thereby, when normally operated, the door lock device of the invention behaves as a traditional device without emergency release mechanism; by means of its rotation usually contrasted by a spring, the latch snappingly engages the striker means in response to the door closing, the latch being introduced into a receiving seat of the frame in which the striker means are arranged.

By pushing against the door, a child closed inside the electric household appliance exerts a traction on the latch in the direction of introducing the latch into the receiving seat. The jaws are then splayed against the bias of the elastic means, partially protruding from the receiving seat with their T-shaped ends provided with teeth forming the striker means, thus releasing the latch; the door may thus be opened.

The jaws are advantageously shaped at right angles and are carried by at least one of a second pair of walls of the frame which are spaced apart by a greater distance than a first pair of walls of the same, perpendicularly thereto, which are spaced apart by a predetermined distance.

Thereby, the receiving seat for the latch and the housing seats for the elastic means may be obtained between the walls of the second pair, while the walls of the first pair may be spaced apart by the same distance L as a door lock device not serving the function of emergency opening, with a great advantage in terms of small dimensions.

BRIEF DESCRIPTION OF THE DRAWINGS

Further features and advantages of the present invention will be apparent from the following description of a preferred embodiment thereof, merely provided by way of non-limitative example, with reference to the accompanying drawings, in which.

BEST MODE FOR CARRYING OUT THE INVENTION

With reference to figures from 1 to 3, numeral 1' indicates a frame of a traditional door lock device, without emergency release; frame 1', which is constrainable in use to the casing of the electric household appliance, has a width L (FIG. 2) and is integrally provided with a tooth 11', forming striker means for a latch 2 carried by the door of the electric household appliance (not shown); latch 2 rotates about a pin 21 having the axis parallel to the door hinging axis and is provided with a tooth 22; the door closing pushes the latch 2 to cooperate with the tooth 11' thus rotating it in direction B (FIG. 2), usually against the bias of a contrast spring (not shown), and once the tooth 11' has been passed, latch 2 then rotates again but in direction A (FIG. 2) under the bias of the aforesaid spring, snappingly engaging the tooth 11' by means of the tooth 22. Under these conditions, the door is locked until the latch 2 is rotated again in direction B, e.g. by means of an appropriate handle (not shown).

Figure 6:
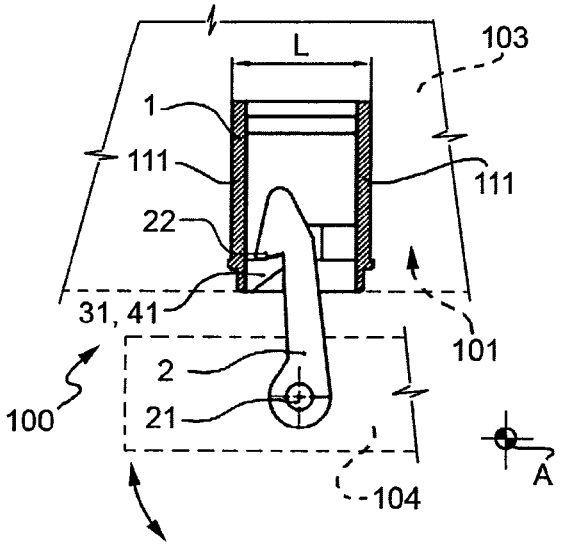
FIG. 6 shows the device in FIGS. 4 and 5 in the same view and configuration as the known device in FIG. 3.

With reference to figures from 4 to 8 instead, numeral 100 indicates as a whole a door lock device for an electric household appliance 101 (FIG. 6), in particular a dryer, of which part of a casing 103 and a door 104 rotating in use about an axis A are shown by means of a dashed line; the electric household appliance 101 is provided with a movable latch 2 which is identical to the one used for the door lock device of the prior art, carried by the door 104 rotating about a pin 21 parallel to axis A, and therefore rotating about a plane normally perpendicular to axis A (sheet plane in FIG. 6).

Figure 5:
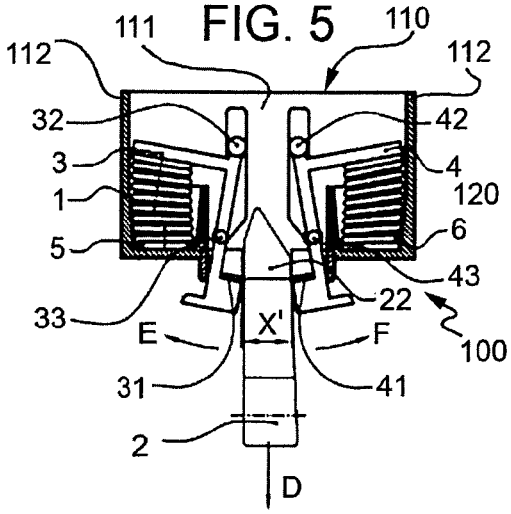

The device 100 comprises a frame 1 carried in use by the casing 103 of the electric household appliance 101 and provided with striker means 31,41 (FIG. 6) for the tooth 22 of latch 2; according to an aspect of the invention, the striker means 31,41 instead of consisting of a tooth integral with the frame, as in the case of the prior art device, are obtained on a pair of opposite jaws 3,4 carried by the frame 1 adjacent to each other and movable against the bias of elastic means 5,6; frame 1 is further provided with guiding means 110 for the jaws 3,4 adapted to cause the jaws to be driven apart from each other, as will be explained, in response to a traction D (FIG. 5) exerted in use on the latch 2 when this engages the striker means 31,41.

Furthermore, the elastic means 5,6 and the guiding means 110 are arranged so that the movement of the jaws 3,4 occurs on a plane (sheet plane in FIGS. 4 and 5) arranged perpendicular in use to the rotation plane of latch 2 (sheet plane in FIG. 6) so as to release the striker means 31,41 from the latch 2.

Figure 4:
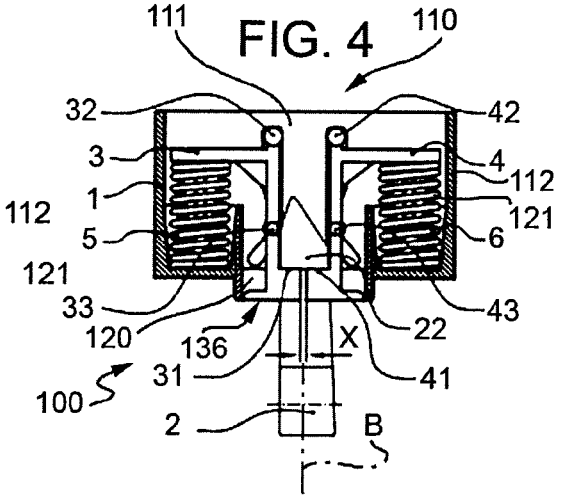
FIGS. 4 and 5 show diagrammatic, vertical section views of a door lock device provided according to the invention.

In particular, the striker means consist of a respective tooth 31 for jaw 3 and a respective tooth 41 for jaw 4 which extend to protrude from the jaws 3,4 on a plane perpendicular to the rotation plane of latch 2; each tooth 31,41 is further shaped so as to be adapted to engage in use only part of the corresponding fastening tooth 22 of latch 2, so that between the teeth 31,41, which are in use opposite to each other with respect to the latch 2 like the jaws 3,4 also are, there remains in all cases a clearance X with door 104 in locked conditions (FIG. 4).

Frame 1 is delimitated between a first pair of walls 111 and a second pair of walls 112, reciprocally parallel in pairs; the first pair of walls 111, arranged in use perpendicularly to the rotation plane of latch 2, are arranged at a predetermined reciprocal distance L identical to the width of the known devices and shorter than that at which the second pair of walls 112 are arranged, so that a receiving seat 120 for the latch 2 may be obtained between walls 112, having an axis B parallel to a direction of introducing the latch 2 into frame 1, as well as respective housing seats 121 for the elastic means 5,6 may be obtained on both sides of the receiving seat 120.

Figure 8:
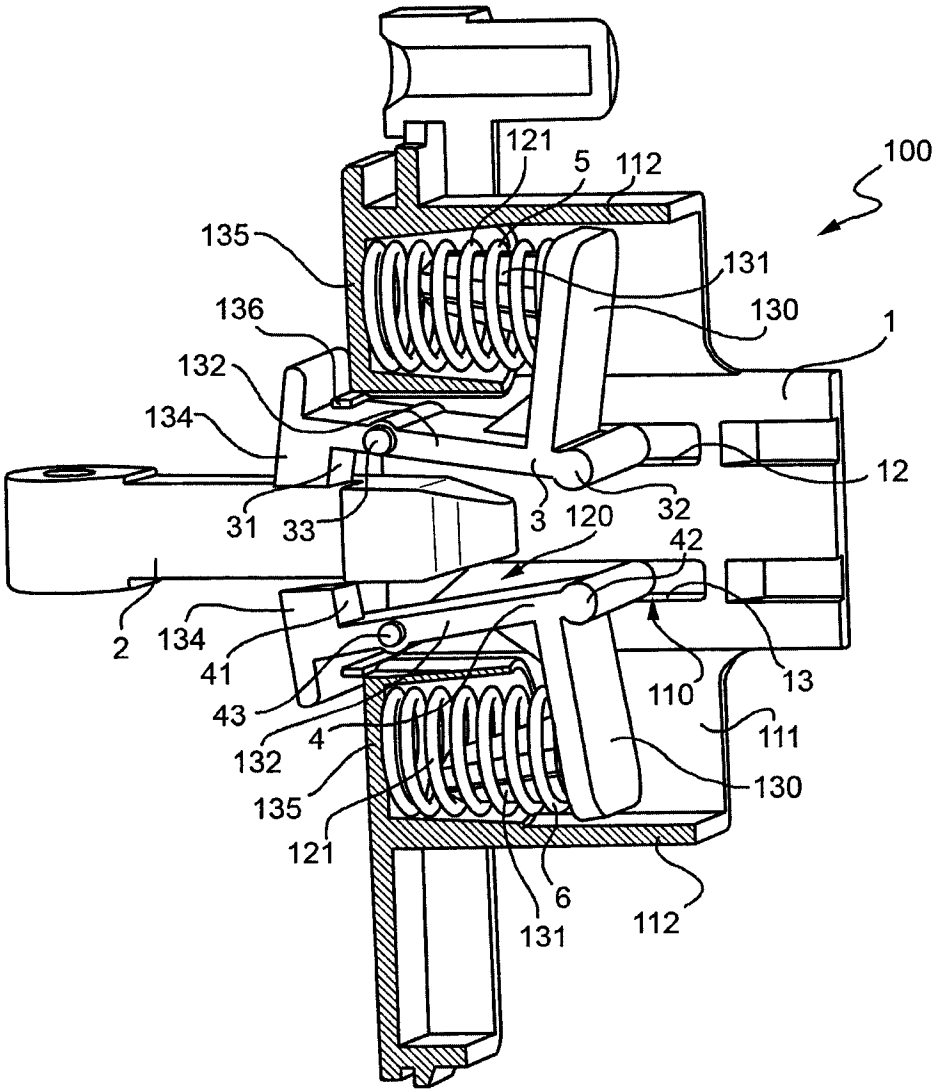
FIG. 8 is a longitudinal section of an axonometric view, according to the same vertical section plane as FIGS. 4 and 5, of the door lock device of the invention.

Each jaw 3,4 is carried by at least one of the walls 111 (in this illustrated case, by both) and on a plane parallel to the laying plane thereof, is shaped at right angles and has (FIG. 8) a first arm 130 provided with a substantially conical appendix 131 arranged by the side of the seat 120, and a second arm 132 arranged at least partially within the seat 120, on one side thereof, and provided at its free end with a T-shaped head 134 provided with a tooth 3 for the jaw 3 and a tooth 41 for the jaw 4, both protruding towards the middle of the seat 120.

The appendixes 131 of the arms 130 of both jaws 3,4 are each fitted into a respective helical spring 5,6 forming the mentioned elastic means; the springs 5,6 are accommodated within the seats 121, each sandwiched between the arm 130 of the corresponding jaw 3,4 and a bottom wall 135 of the corresponding housing seat 121, the bottom wall 135 facing the side of an inlet opening 136 of the receiving seat 120 of latch 2.

Figure 7:
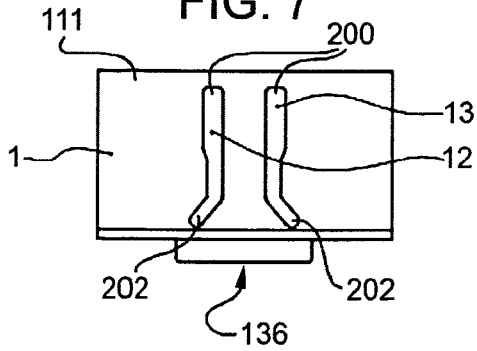
FIG. 7 is a side view of the device in FIGS. 4 and 5 with parts removed for simplicity.

According to a further aspect of the invention, the guiding means 110 comprise a pair of slots 12,13 obtained through the wall 111 carrying the jaws 3,4, in the illustrated case on both walls 111, although only one is shown; each slot 12,13 has a rectilinear segment 200 (FIG. 7) and, towards the receiving seat 120 for the latch 2, an oblique segment 202, these oblique segments 202 of the two slots 12,13 moving away from each other towards the inlet opening 136 of the same receiving seat 120.

The guiding means 110 further comprise a pair of pins 32,33 for jaw 3 and 42,43 for jaw 4, respectively engaged in the corresponding slots 12 and 13; the first pins 32,42 are obtained at the joint between the first and second arms 130 and 132 of each jaw 3,4 shaped at right angles, and the second pins 33,43 are instead obtained on the second arm 132 of each jaw 3,4, towards the T-shaped head 134 thereof.

Thereby, by virtue of the described arrangement of pins 32,33 and 42,43 and of the shape of slots 12,13, the jaws 3,4 are adapted to take a first operating position (FIG. 4), in which the T-shaped heads 134 are housed within the seat 120 abutting against the respective side walls thereof so as to prevent in use the release of latch 2 from the teeth 31,41 in fastening position (FIG. 6).

For the same reason, jaws 3,4 are further adapted to take a second operating position (FIGS. 5 and 8) against the bias of the elastic means 5,6, in which the jaws 3,4 are splayed with the T-shaped heads 134 out of the seat 120; in such a configuration, the distance or clearance between the opposite teeth 31,41 is X' (FIG. 5), much greater than the starting clearance and even greater than the corresponding dimension of latch 2, whereby the emergency release of latch 2 from the striker means (teeth 31,41) is allowed.

Figure 1:
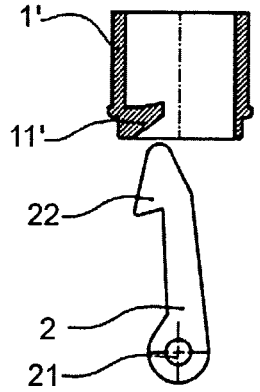
FIGS. 1, 2 and 3 show diagrammatic, horizontal section views of a door lock device for a door with movable latch without emergency opening function, according to the prior art, in three different operating positions.
Figure 2:
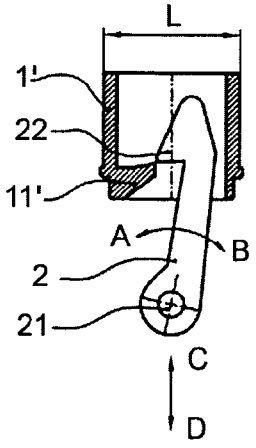
Figure 3:
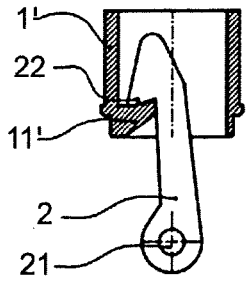

In essence, the springs 5,6 normally keep the jaws 3,4 in the first operating position, in which the teeth 31,41 serve the same function as the tooth 11' of the known device in FIGS. 1-3.

If a child exerts a push D on the door 104 from the inside of the electric household appliance 101 capable of overcoming the load of the springs 5,6, these are compressed and the jaws 3,4 start to rotate and to translate at the same time, under the combined bias of pins 32,33 and 42,43 and slots 12,13, thus splaying and exiting from the seat 120, thereby disengaging the teeth 31,41 from the tooth 22 laterally with respect to the plane in FIG. 6; the device 100 is thus unlocked without the latch 2 needs to rotate, thus releasing the door 104.

The invention claimed is:

1. A door lock device for an electric household appliance including a casing, a door and a movable latch wherein the latch is carried by the door and the latch is rotatable on a rotation plane generally perpendicular to a door rotation axis, the device comprising:

a frame carried by the casing, the frame having a striker, a movable guiding member movable in a direction such that the movable guiding member changes position along a direction along a longitudinal axis of the latch movable in a direction such that the movable guiding member changes position relative to a location along at least one of a longitudinal axis of the latch and a lateral axis of the latch, and an elastic member;

the striker having a pair of opposite jaws carried by the frame adjacent to each other and movable against the bias of the elastic member;

the movable guiding member adapted to cause the jaws to be driven apart from one another in response to a traction exerted on the latch when the latch is engaged with the striker, said elastic member and movable guiding member being arranged so that the movement of the jaws occurs on a plane arranged perpendicular to the rotation plane of the latch and arranged to release the striker from the latch.

2. The door lock device according to claim 1, wherein said striker includes a pair of teeth each opposite to one of said jaws, respectively, each tooth extends to protrude from the corresponding jaw on a plane perpendicular to the rotation plane of the latch;

each tooth being adapted to engage a part of a corresponding fastening tooth of the latch.

3. The door lock device according to claim 1, wherein said frame is delimited by a pair of first walls and a pair of second walls the first walls being arranged perpendicularly to the rotation plane of the latch and arranged at a predetermined reciprocal distance smaller than that of the second walls, a receiving seat having an axis parallel to a direction of introduction of the latch in the frame being positioned between the second walls for receiving the latch, the receiving seat having a pair of third walls and a pair of housing seats for housing said elastic member, each housing seat being positioned between one of the third walls of the receiving seat and one of the second walls.

4. The door lock device according to claim 3, wherein each said jaw is carried by at least one of the first walls and, in a plane parallel to the at least one of the first walls, each said jaw is shaped at right angles including a first arm provided with an appendix arranged approximate a wall of said receiving seat, and a second arm arranged at least partially inside said receiving seat, and provided with a T-shaped head, the elastic member including a pair of helical springs accommodated inside said housing seats, the appendix of the first arm being fitted into the corresponding helical spring accommodated inside said housing seat, the helical spring positioned between the first arm and a bottom wall of the housing seat, and the bottom wall facing an inlet opening of said receiving seat.

5. The door lock device according to claim 4, wherein said movable guiding member includes a pair of slots extending through at least one of said first walls carrying the jaws;

each slot having a rectilinear segment and an oblique segment positioned approximate the receiving seat, wherein the oblique segments of the two slots extending away from each other towards the inlet opening of the receiving seat.

6. The door lock device according to claim 5, wherein said movable guiding member further includes, for each of said jaws, first and second pins engaged with one of the slots, the first pin positioned at the joint between the first and the second arms of each jaw and the second pin positioned on the second arm approximate said T-shaped head;

wherein said jaws are adapted to take a first operating position, in which the T-shaped heads are accommodated within the receiving seats and abut against respective side walls of the receiving seats so as to prevent in use the release of the latch from the striker, and against the bias of said elastic member, a second operating position, in which the jaws are splayed with the T-shaped heads out of the receiving seats, to allow an emergency release of the latch from the striker.

* * * * *